US008690236B2

(12) United States Patent
Gorinas et al.

(10) Patent No.: US 8,690,236 B2
(45) Date of Patent: Apr. 8, 2014

(54) RECONFIGURABLE COLLAPSIBLE CHAIR

(75) Inventors: Kristine Rose Gorinas, Lawrenceville, GA (US); John P. Oliver, Gulf Breeze, FL (US)

(73) Assignee: Swimways Corporation, Virginia Beach, VA (US)

( * ) Notice: Subject to any disclaimer, the term of this patent is extended or adjusted under 35 U.S.C. 154(b) by 187 days.

(21) Appl. No.: 12/855,133

(22) Filed: Aug. 12, 2010

(65) Prior Publication Data

US 2011/0049942 A1 Mar. 3, 2011

Related U.S. Application Data

(60) Provisional application No. 61/274,026, filed on Aug. 12, 2009.

(51) Int. Cl.
*A47C 13/00* (2006.01)
*A47C 4/00* (2006.01)

(52) U.S. Cl.
USPC ..... 297/118; 297/16.2

(58) Field of Classification Search
USPC ..... 297/16.2, 118, 184.11, 184.13, 219.12, 297/256.17
See application file for complete search history.

(56) References Cited

U.S. PATENT DOCUMENTS

| | | | | |
|---|---|---|---|---|
| 2,731,072 | A * | 1/1956 | Post | 297/6 |
| 3,580,633 | A * | 5/1971 | Du Priest | 297/184.1 |
| 3,997,213 | A * | 12/1976 | Smith et al. | 297/118 |
| 5,213,360 | A * | 5/1993 | Lin | 280/648 |
| D432,325 | S | 10/2000 | Zheng et al. | |
| 6,237,998 | B1 * | 5/2001 | Aprile | 297/219.12 |
| 6,647,560 | B1 * | 11/2003 | Hingley et al. | 4/484 |
| 6,736,450 | B2 | 5/2004 | Miyagi | |
| 6,755,462 | B2 | 6/2004 | Zheng | |
| 6,851,749 | B2 * | 2/2005 | Norman | 297/256.17 |
| 6,889,393 | B1 * | 5/2005 | Rinaldo | 4/484 |
| 7,156,458 | B2 * | 1/2007 | Hanberg | 297/219.12 |

(Continued)

FOREIGN PATENT DOCUMENTS

| | | | |
|---|---|---|---|
| CN | 101301151 | A | 11/2008 |
| EP | 0 644 100 | A1 | 3/1995 |
| JP | 2003-102588 | A | 4/2003 |

OTHER PUBLICATIONS

International Search Report and Written Opinion for International Patent Application No. PCT/US10/45297, mailed on Oct. 28, 2010; 6 pages.

(Continued)

*Primary Examiner* — Philip Gabler
(74) *Attorney, Agent, or Firm* — Cooley LLP

(57) ABSTRACT

An apparatus includes a frame having a collapsed configuration and an expanded configuration. A first membrane is coupled to the frame and includes a seat portion with first and second openings. A second membrane is couplable to the first membrane and/or the frame and is configured to be moved between a first position in which the second membrane covers the first and second openings, and a second position in which the first and second openings are not covered by the second membrane. The frame and the first membrane are configured to support a user in a seated position when the second membrane is in the first position and the frame is expanded, the first and second openings are each configured to receive a leg of a user when the second membrane is in the second position and the frame is expanded to support the user in a standing position.

15 Claims, 16 Drawing Sheets

(56) References Cited

U.S. PATENT DOCUMENTS

| | | | | |
|---|---|---|---|---|
| 7,281,759 | B1 * | 10/2007 | Strong et al. | 297/45 |
| 2005/0264056 | A1 | 12/2005 | Hanberg | |
| 2008/0129001 | A1 | 6/2008 | Emerson | |
| 2009/0250978 | A1 * | 10/2009 | Reynolds | 297/16.2 |

OTHER PUBLICATIONS

Office Action for Chinese Patent Application No. 201080041714.7, mailed on Nov. 28, 2013, 13 pages.

* cited by examiner

RECONFIGURABLE COLLAPSIBLE CHAIR

CROSS-REFERENCE TO RELATED APPLICATIONS

This application claims priority to and the benefit of U.S. Provisional Patent Application No. 61/274,026, filed on Aug. 12, 2009, and entitled "Go & Grow Chair/Seat," the disclosure of which is hereby incorporated herein by reference in its entirety.

BACKGROUND

Some embodiments relate generally to a chair having multiple configurations, and in particular, to a reconfigurable collapsible chair that can be disposed in multiple different configurations for use, and a collapsed configuration for transport.

Known collapsible chairs are available in various sizes and can include various accessory features such as cup holders and sun shades. Such collapsible chairs are often transportable and can be used in various outdoor settings. Known collapsible chairs, however, disadvantageously only have a single use configuration and therefore, may only accommodate a particular size or age of users in a seated position. For example, some known collapsible chairs are sized to be used by a typical adult, while other collapsible chairs may be sized and configured to be used only by a young child.

Thus, a need exists for a reconfigurable and collapsible chair that can be collapsed for transport, and can be easily converted between various configurations to accommodate various sizes and ages of users.

SUMMARY

In some embodiments, an apparatus includes a frame having a collapsed configuration and an expanded configuration. A first membrane is coupled to the frame that includes a seat portion. The seat portion of the first membrane defines a first opening and a second opening. A second membrane is couplable to at least one of the first membrane or the frame. The second membrane is configured to be moved between a first position in which the second membrane is disposed at least partially over the seat portion of the first membrane such that the first opening and the second opening are disposed beneath the second membrane, and a second position in which the first opening and the second opening are not covered by the second membrane. The frame and the first membrane are collectively configured to support a user in a seated position on the apparatus when the second membrane is in the first position and the frame is in the expanded configuration, the first opening and the second opening each configured to receive a leg of a user when the second membrane is in the second position and the frame is in the expanded configuration such that the user is supported in a standing position on the apparatus.

DETAILED DESCRIPTION

Figure 1:
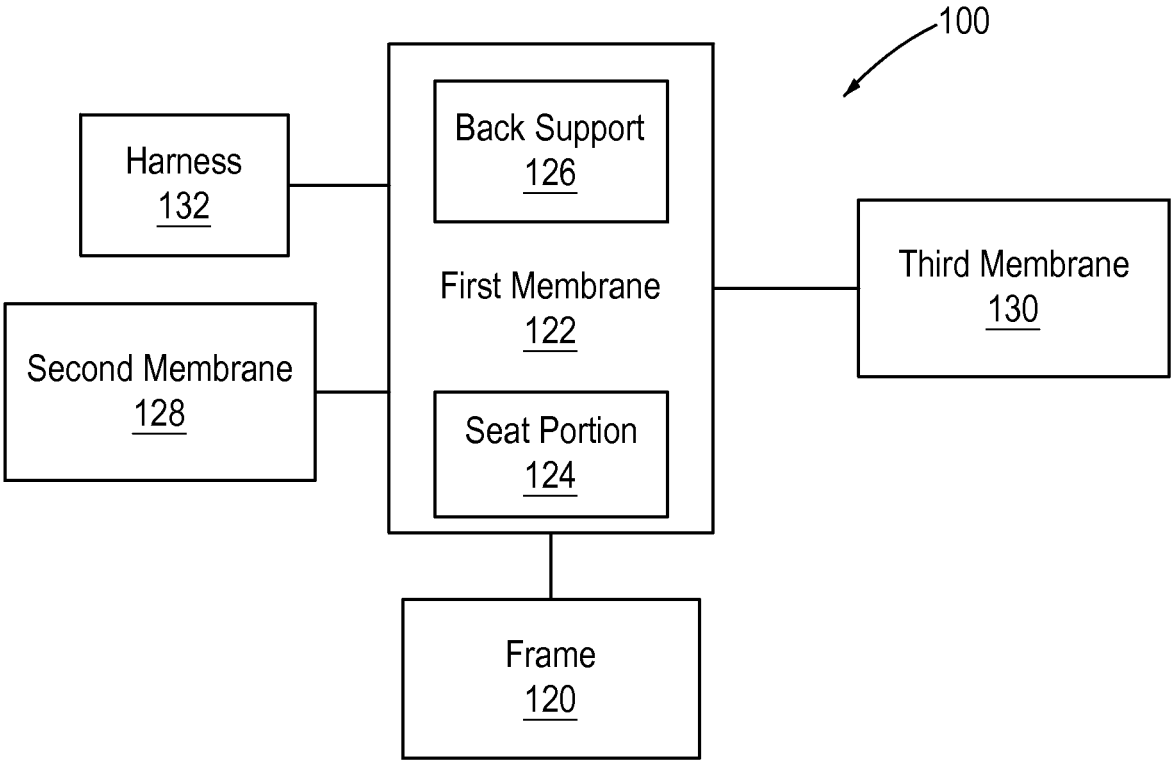
FIG. 1 is a schematic illustration of a reconfigurable collapsible chair according to an embodiment.

Apparatus and kits are described herein related to a reconfigurable and collapsible chair that provides versatility for use by users varying in age and size, for example, for a newborn baby through a school age child. For example, as described herein the reconfigurable chair can include a harness to support a baby in a seated or standing position on the chair. The reconfigurable chair can also be converted or reconfigured to allow a child, for example, a child weighing up to 75 pounds or more, to be supported in a seated position on the chair without the use of a harness. In some embodiments, an enclosure can be provided to enclose the user's legs and feet when supported on the chair in a standing position. For example, such an enclosure can protect the user from insects and the ground (e.g., dirt, cement, etc. when used outdoors).

As described herein, the reconfigurable chair can be moved between a closed or collapsed configuration for storage and transport, and an open or expanded configuration for use. The reconfigurable chair can include one or more membranes coupled to a frame including multiple frame members pivotally coupled together such that the reconfigurable chair can be easily moved between its collapsed and expanded configurations. The one or more membrane can be formed with or constructed from a material that resists fading, stains and mold such that the reconfigurable chair can be used inside or outside. In some embodiments, the frame includes an anti-tip mechanism to provide additional stability. For example, in some embodiments, at least some of the frame members can include an angled foot portion configured to support the chair on a support surface. In some embodiments, a separate foot frame member is disposed at angle relative to, for example, the side frame members of the frame.

In some embodiments, the reconfigurable chair is lightweight and portable and can be provided with a carrying bag that can also be used to contain various accessory components as described in more detail below. For example, in some embodiments, the reconfigurable chair can include a removable sun shade or canopy and/or a removable tray.

In some embodiments, an apparatus includes a frame having a collapsed configuration and an expanded configuration. A first membrane is coupled to the frame that includes a seat portion. The seat portion of the first membrane defines a first opening and a second opening. A second membrane is couplable to at least one of the first membrane or the frame. The second membrane is configured to be moved between a first position in which the second membrane is disposed at least partially over the seat portion of the first membrane such that the first opening and the second opening are disposed beneath (or covered by) the second membrane, and a second position in which the first opening and the second opening are not covered by the second membrane. The frame and the first membrane are collectively configured to support a user in a seated position on the apparatus when the second membrane is in the first position and the frame is in the expanded configuration, the first opening and the second opening each configured to receive a leg of a user when the second membrane is in the second position and the frame is in the expanded configuration such that the user is supported in a standing position on the apparatus.

In some embodiments, an apparatus includes a frame having a collapsed configuration and an expanded configuration. A first membrane is coupled to the frame and includes a seat portion. The seat portion of the first membrane defines a first opening and a second opening each configured to receive a leg of a user of the apparatus when the frame is in the expanded configuration. A second membrane is couplable to at least one of the frame and the first membrane. The second membrane has a first position in which the second membrane is disposed below the seat portion of the first membrane and forms an enclosure defining an interior region configured to receive at least a portion of the legs of the user when the frame is in the expanded configuration, and a second position in which the second membrane is in a stowed position.

In some embodiments, an apparatus includes a frame having a collapsed configuration and an expanded configuration. The frame includes multiple frame members and at least one frame member includes a first portion and a second portion. The second portion being disposed at an angle relative to the first portion and the second portion being configured to support the apparatus on a support surface. A membrane is coupled to the frame. The membrane has a seat portion and a back support portion. The frame and the membrane are collectively configured to support a user in a seated position and/or a standing position when the frame is in the expanded configuration.

As used in this specification, the singular forms "a," "an" and "the" include plural referents unless the context clearly dictates otherwise. Thus, for example, the term "a membrane" is intended to mean a single membrane or a combination of membranes.

FIG. 1 is a schematic illustration of a reconfigurable collapsible chair (also referred to herein as "reconfigurable chair" or "chair"). The reconfigurable chair 100 includes a frame assembly 120 (also referred to herein as "frame) and a first membrane 122 coupled to the frame assembly 120. The frame 120 can include multiple frame members (not shown in FIG. 1) coupled together such that the frame can be moved between a closed or collapsed configuration and an open or expanded configuration. For example, at least some of the frame members can be pivotally coupled to one another to allow the frame 120 to be folded to the collapsed configuration. The chair 100 can be collapsed and expanded by bringing the frame members toward each other and away from each other, respectively.

The frame 120 can also include multiple frame connectors (not shown in FIG. 1) coupled to at least some of the frame members. The frame members can be coupled to the connectors with, for example, a fastener such as a rivet, screw and/or bolt. The frame 120 can include one or more different configurations of connectors depending on the particular frame members to be coupled and the location of the connector on the frame 120. In some embodiments, the frame 120 includes an angled foot portion (not shown in FIG. 1) configured to contact a support surface and provide additional stability to the chair 100. For example, in some embodiments, at least some of the frame members can also include an angled foot portion. For example, a frame member can have a first portion that is substantially linear or straight and a second portion that is angled relative to the first portion. At least the second portion can be used to support the chair 100 on a support surface. In some embodiments, a frame member can include a first portion that is coupled to a second portion such that the first portion is disposed at an angle relative to the second portion. In some embodiments, a separate foot frame member can be coupled to a connector of the frame such that it is disposed at an angle relative to another frame member. The foot frame member can be coupled to a connector at the same location as another frame member (e.g., share a common fastener), or at a different location than the other frame members.

A cap can be disposed on the end of the angled foot portions of the frame 120 that can contact the support surface. The cap can be, for example, a plastic or rubber cap. The frame 120 can also include a locking mechanism (not shown in FIG. 1) that can be used to maintain the chair 100 in the expanded configuration during use. Further details regarding the frame 120 are described below with reference to specific embodiments.

The first membrane 122 can be formed with one or more portions of material. The first membrane 122 can be formed, for example, with an upholstery grade fabric that resists fading, stains and mold. The first membrane 122 can include a seat portion 124 and a back support portion 126. In some embodiments, the seat portion 124 can define a first opening and a second opening (not shown in FIG. 1) each configured to receive a leg of a user therethrough when the user of the chair 100 is in a standing position as described in more detail below. The back support portion 126 can be slightly reclined and can include cushioned portions. The cushioned portions can be used to help stabilize the head and/or body of a user of the chair 100.

The chair 100 can also include a second membrane 128 in the form of a seat cover configured to be coupled to the first membrane 122 and/or the frame 120 and/or a first storage pouch or pocket (not shown in FIG. 1). The first storage pouch can be coupled, for example, to the frame 120 and/or the first membrane 122. The second membrane 128 can be moved between a first position in which the second membrane 128 is disposed on the seat portion 124 such that the first opening and the second opening are covered by the second membrane 128, and a second position in which the second membrane 128 is not disposed on (not covering) the seat portion 124 and the first opening and the second opening are uncovered or exposed. The second membrane 128 can be stored within the first storage pouch when the second membrane 128 is in its second position. When the second membrane 128 is in its first position, and the frame is in the expanded configuration, a user of the chair 100 can be supported on the chair in seated position. When the second membrane 128 is in its second position, the user of the chair 100 can be supported in a standing position with its legs inserted through the first opening and the second opening. Thus, movement of the second membrane 128 between its first position and its second position allows the chair 100 to be reconfigured for use by a user in a sitting or standing position, respectively.

Such a configuration may be desirable, for example, to accommodate various stages of a user's life. For example, an infant (e.g., a baby between the ages of 3 and 6 months) can be supported in the chair 100 in a seated position, and then as that baby grows to, for example, 6 to 12 months of age, the baby can be supported in the chair 100 in a seated or standing position to allow the baby to stretch and stand with the support of the chair 100. A harness 132 can be coupled to the first membrane 122 and/or the frame 120 to securely hold the baby in position in either the seated or standing positions. The harness 132 can include a harness membrane (not shown in FIG. 1) and connectors used to removably couple the harness to the first membrane 122. In some embodiments, the harness 132 is coupled to the first membrane 122 at three coupling locations. For example, the harness 132 can be coupled at a first location on the seat portion 124 of the first membrane 122 and at two locations on the back support portion 126 of the first membrane 122. The harness 132 is described in more detail below with reference to specific embodiments. As the baby/child continues to grow, the child can continue to use the chair 100 as a seat without the use of the harness. 132

The second membrane 128 can be removably coupled to the first membrane 122 or a storage pouch (not shown) with various attachment methods, such as for example, snaps, buckles, straps, hook and loop fasteners (e.g., VELCRO®), etc. The second membrane 128 can also be coupled to the first membrane 122 and/or the frame 120 and/or storage pouch such that at least a portion of the second membrane 128 is fixedly attached to the frame 120 and/or the first membrane 122 and/or the storage pouch. For example, a portion of the second membrane 128 can be sewn or otherwise attached, to the first membrane 122 (and/or the storage pouch and/or frame 120) such that the second membrane 128 can be moved between its first position and its second position while remaining attached to the first membrane 122 (and/or the storage pouch and/or the frame 120). When the second membrane 128 is in its first position disposed on the seat portion 124 of the first membrane 122, the second membrane 128 can also be removably coupled to, for example, the back support portion 126 of the first membrane 122. For example, the second membrane 128 can be coupled to the back support portion 326 with snaps, straps, buckles, and/or buttons, etc. In some embodiments, the second membrane 128 can be formed monolithically with (unitarily with) or integrally to the first membrane 122 and/or the first storage pouch.

The chair 100 can also include a third membrane 130 in the form of an enclosure that can be coupled to the frame 120 and/or the first membrane 122. The third membrane 130 can be moved between a first position in which the third membrane 130 is in a stored position and a second position in which the third membrane 130 forms an enclosure below the seat portion 124 of the first membrane 122 configured to receive the feet and at least a portion of legs of a user. More specifically, when the user is supported in the chair 100 in the standing position with the user's legs disposed through the first opening and the second opening of the seat portion 124 of the first membrane 122, the third membrane 130 can be in its second position to provide an enclosure for the user's feet and legs. This may be desirable, for example, to protect the user's legs from insects and or dirt when the chair 100 is used outdoors.

The chair 100 can include a second storage pouch or pocket (not shown in FIG. 1) in which the third membrane 130 can be stored when the third membrane 130 is in its first position. For example, the second storage pouch can be coupled to the frame 120 and/or the first membrane 122 beneath the seat portion 124 of the first membrane 122, such that the third membrane 130 can be stored beneath the seat portion 124 and readily available for use.

A portion of the third membrane 130 can be fixedly coupled to the frame 120 and/or the first membrane 122 and/or second storage pouch. For example, a portion of the third membrane (e.g., a top edge) can be sewn or coupled to the frame 120 and/or first membrane 122 and/or second storage pouch. In alternative embodiments, the third membrane 130 can be removably coupled to the frame 120 and/or the first membrane 122 and/or the second storage pouch. The third membrane 130 can include a coupling member, such as, for example, snaps, buckles, straps, hook and loop fasteners, etc. to couple the third membrane to the first membrane 122 and/or the frame 120 and/or the second storage pouch when in its second position deployed as an enclosure beneath the seat portion 124.

The chair 100 can also include a pair of arm rests (not shown in FIG. 1). The arm rests can each include an arm membrane that is coupled to an arm support portion of the frame 120 such that the arm rests can be folded or collapsed when the frame 120 is moved to its closed or collapsed configuration and can be positioned to support a user's arms when the frame 120 is in the open or expanded configuration. The arm rests can optionally include a cup or drink holder. For example, a drink holder membrane can be coupled to or formed integrally or monolithically with an arm membrane. The chair 100 can also optionally include side panels coupled to the arm membranes and/or the frame 120 and/or the first membrane 122. The side panels can extend between the arm rests and the first membrane 122. For example, the side panels can extend between the seat portion 124, the back portion 126 and the arm rests to partially enclose a portion of the chair 100 in which the user will be disposed during use.

The side panels and the arm rests can each be formed with the same or different material as the first membrane 122 and/or the second membrane 128 and/or the third membrane 130. The side panels and the arm rests can also each be formed with one or more portions of material. In some embodiments, the side panels can be formed integrally or monolithically with the arm rests and/or the first membrane 122.

In some embodiments, the chair 100 can be provided as a kit with various accessories. For example, in some embodiments, a detachable sun canopy (not shown in FIG. 1) and/or a detachable tray (not shown in FIG. 1) can be provided with the chair 100 and can be stored in a carrying bag (not shown in FIG. 1). For example, in some embodiments, a sun canopy can be provided that can be removably coupled to the frame 120 of the chair 100. In some embodiments, a tray can be provided that can be removably coupled to, for example, the arm rests of the chair 100.

The first membrane 122, the second membrane 128, the third membrane 130, the arm membranes, side panels, sun canopy, and tray membrane can each be formed with the same or different material and can be formed with one or more portions of material. In some embodiments, the second membrane 128 and/or the third membrane 130 can be formed integrally or monolithically with the first membrane 122.

The first membrane 122, the harness membrane, the second membrane 128, the third membrane 130, the arm membrane, side panels, sun canopy, the tray membrane and other membrane described herein can each be formed with any suitable strong, weather resistant, flexible material. Suitable fabrics can include, for example, nylon, cotton, rayon, fiberglass fabrics and flexible plastic sheets. In some embodiments, the first membrane 122, the harness membrane, the second membrane 128, the third membrane 130, the arm membranes, side panels, sun canopy, and tray membrane can each be formed at least in part with a mesh material.

The frame 120 (e.g., its frame members) can be formed with any suitable strong, resilient, lightweight, material(s). The frame members can be formed, for example, with plastic, aluminum, and/or wood. Tubular materials can also be suitable. The connectors can be formed with, for example, plastic, aluminum, and/or steel.

Figure 2:
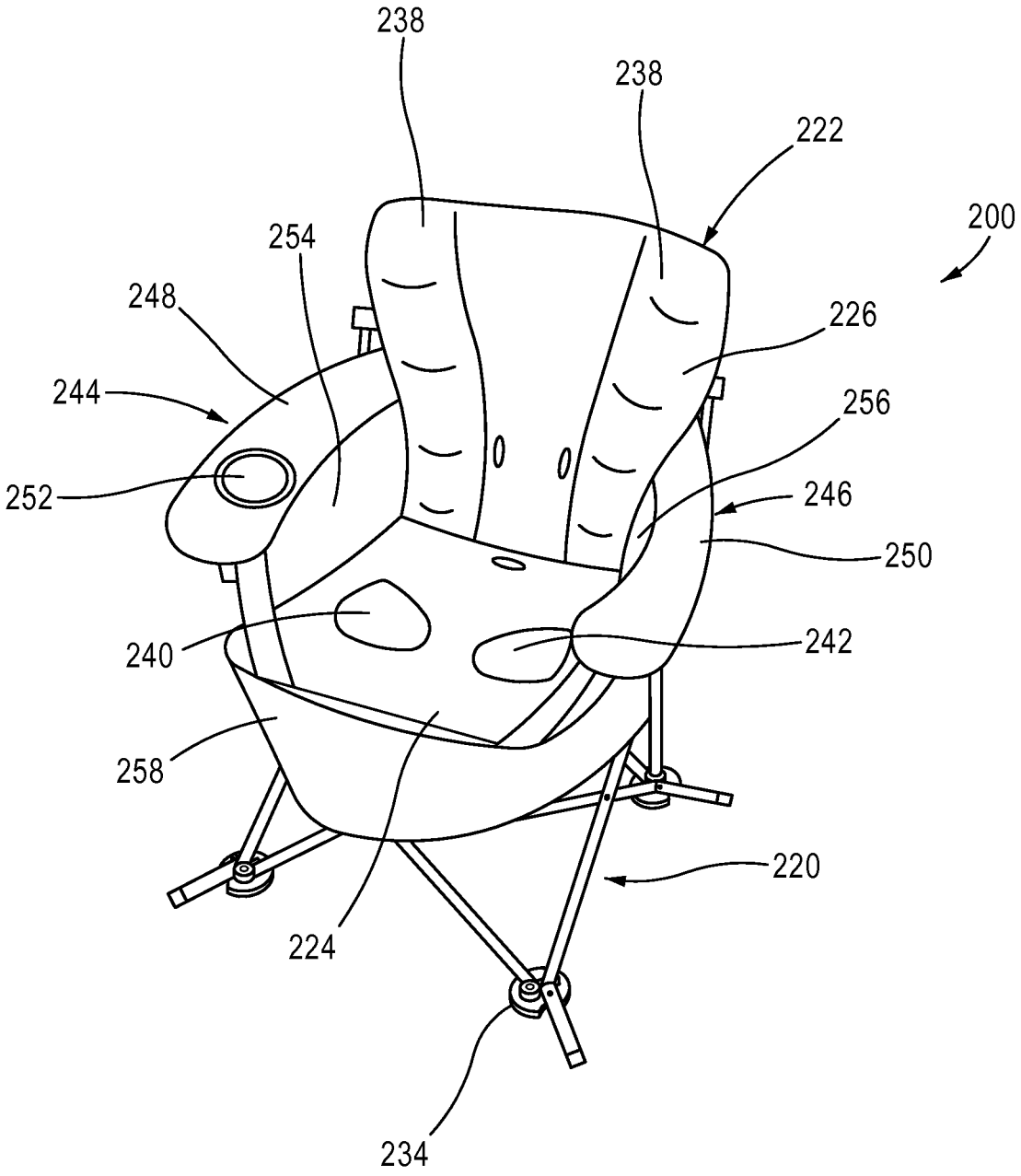
FIG. 2 is a front perspective view of a reconfigurable collapsible chair, according to an embodiment.

FIGS. 2-17 illustrate a reconfigurable collapsible chair according to an embodiment. As shown in FIG. 2, a reconfigurable collapsible chair 200 (also referred to as reconfigurable chair" or "chair") includes a frame assembly 220 (also referred to herein as "frame) and a first membrane 222 coupled to the frame assembly 220. The frame 220 includes multiple frame members (described in more detail below) and multiple frame connectors 234. The frame members are coupled together such that the frame 220 can be moved between a closed or collapsed configuration (see e.g., FIG. 3*b*) and an open or expanded configuration (see e.g., FIGS. 2 and 3*a*). Thus, the chair 200 can be moved between a collapsed configuration and an expanded configuration as described previously.

The first membrane 222 includes a seat portion 224 and a back support portion 226. The first membrane 222 can be formed in a similar manner as described above with reference to FIG. 1. The back support portion 226 can include cushioned portions 238 that can help stabilize or support the head or body of a user of chair 200. The seat portion 224 defines a first opening 240 and a second opening 242 configured to receive a user's legs therethrough.

The chair 200 also includes a first arm rests 244 and a second arm rests 246. The first arm rests 244 includes an arm membrane 248 and the second arm rest 246 includes an arm membrane 250. In this embodiment, the first arm rest 244 also includes a drink holder 252. Although not shown, the second arm rests 246 can also include a drink holder. A first side panel 254 and a second side panel 256 extend between the arm rests 244 and 246, respectively, and the first membrane 222. The side panels 254 and 256 provide a partial enclosure for the body of a user of the chair 100. Also shown in FIG. 2 is a first pouch or pocket 258 described in more detail below.

Figure 3A:
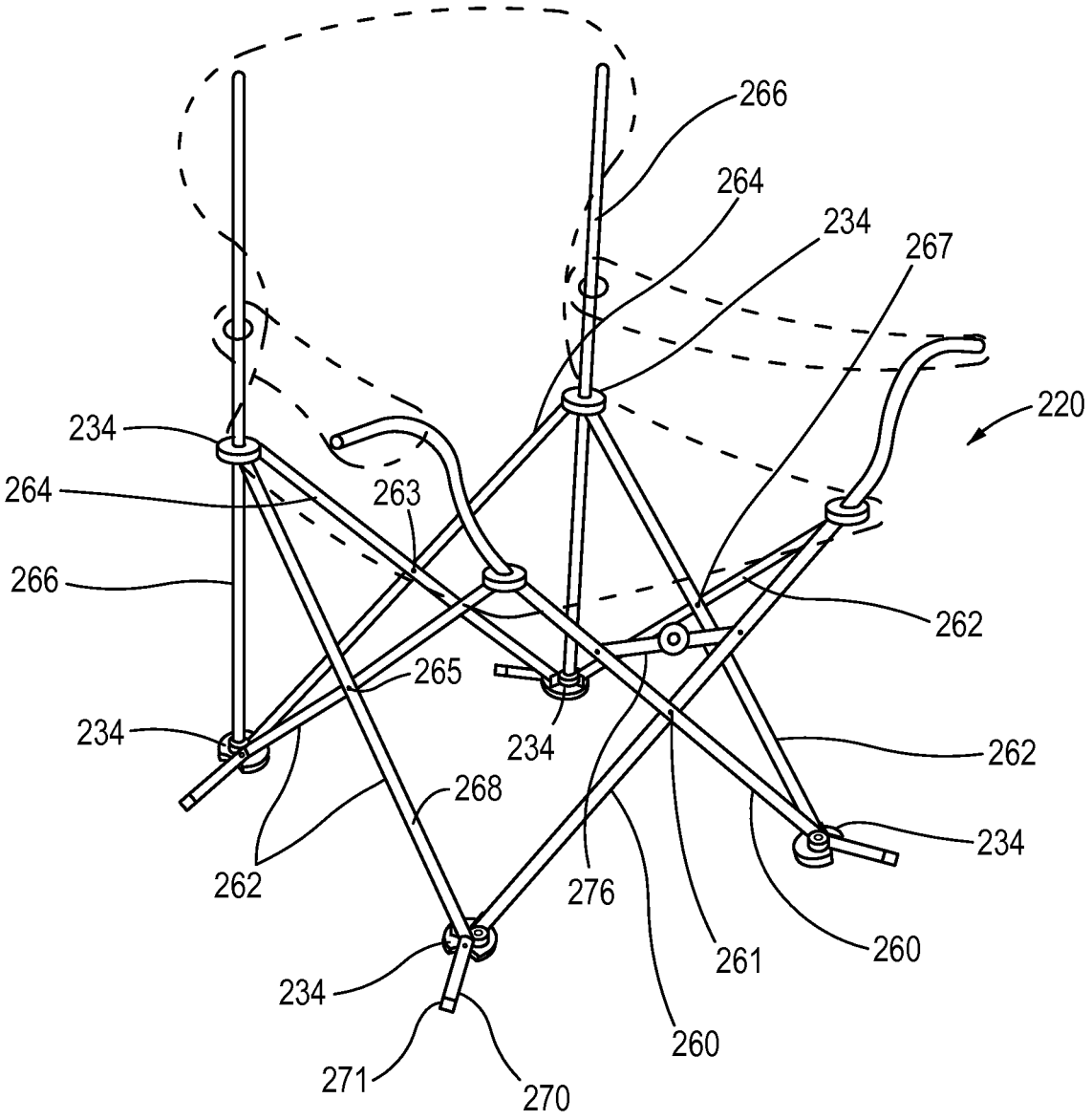
FIG. 3*a* is front perspective view of a frame assembly of the reconfigurable collapsible chair of FIG. 2, shown in an expanded configuration.
Figure 3B:
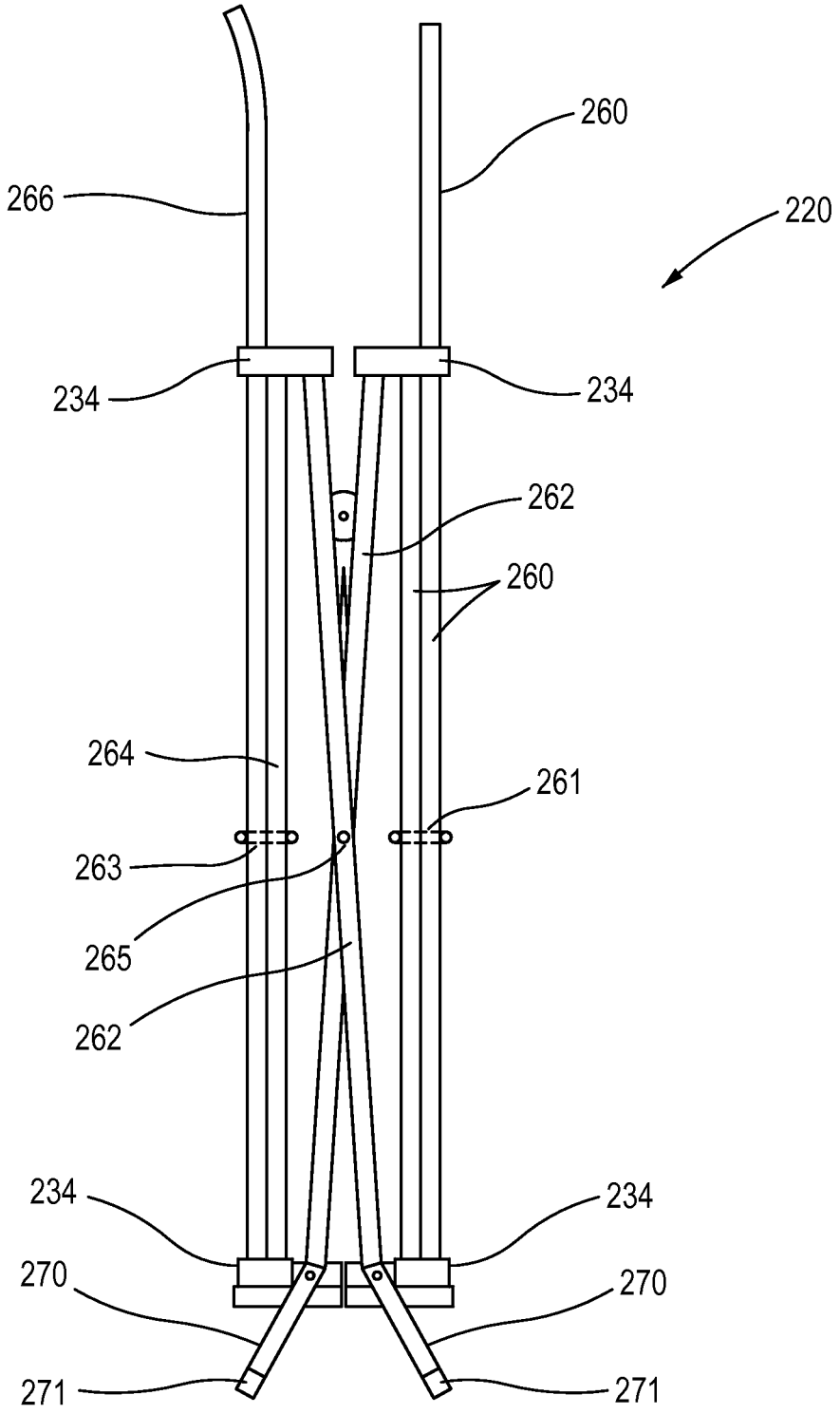
FIG. 3*b* is a side view of the frame assembly of FIG. 3*a* shown in a collapsed configuration.

As shown in FIGS. 3*a* and 3*b*, the frame 220 includes front frame members 260, side frame members 262, rear frame members 264, upright or vertical frame members 266, and a locking mechanism 267 pivotally coupled to the front frame members 260. The front frame members 260 are pivotally coupled at 261 with a pin or other known pivotal coupling member and are fixedly coupled at a bottom end to a connector 234. A top portion of each of the front frame members 260 includes an angled or curved portion configured to be coupled to the arm membranes 248 and 250. The angled or curved portions of the front frame members 260 together with the arm membranes 248 and 250 form the arm rests 244 and 246.

The rear frame members 264 are pivotally coupled at 263 in a similar manner as the front frame members 260. The end portions of each of the rear frame members are coupled to a connector 234. The upright frame members 266 are each fixedly coupled at a bottom end portion to a connector 234 and at an intermediate location are slidably coupled to a connector 234.

The side frame members 262 are pivotally coupled at locations 265 and 267 in a similar manner as described for the front frame members 260 and rear frame members 264. A top end portion of each of the side frame members 262 is fixedly coupled to a connector 234 and a bottom portion of each of the side frame members 262 is also fixedly coupled to a connector 234. Each of the side frame members 262 include a first portion 268 and a second portion 270 that extends at an angle relative to the first portion 268. The angle can be, for example, an angle between but excluding zero degrees and 180 degrees.

Figure 4:
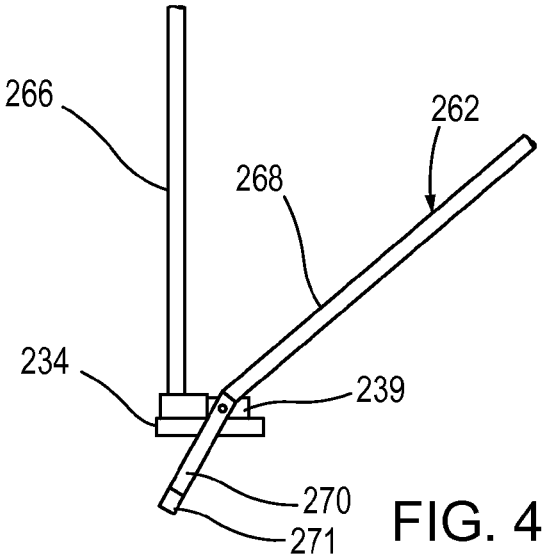
FIG. 4 is side view of a portion of the frame assembly of FIG. 3*a*.

As shown in FIG. 4, the bottom portion of the side frame members 262 extends through a cut-out or opening 236 defined in the connector 234 (see FIG. 5) such that the second portion 270 extends beyond the connector 234. Also shown in FIG. 4, the upright frame member 266 is placed within an opening 237 (see FIG. 5) defined in the connector 234 and fixedly secured thereto in a similar manner. A cap 271 is disposed on the bottom end of the second portion 270 of the side frame member 262 and can contact a support surface. A bottom end portion of the first portion 268 of the side frame member 262 is fixedly coupled to a wall 239 of the connector 234, and a top end portion of the second portion 270 is fixedly coupled to the wall 239 of the connector 234. The first portion 270 and the second portion 270 can each be coupled to the connector 234 with, for example a rivet, screw or bolt. In some embodiments, the first portion 268 and the second portion 270 can each be coupled to the connector 234 at the same location on the connector 234 (as shown in FIG. 4) and shared a common fastener (e.g., rivet, screw or bolt). In some embodiments, the first portion 268 and the second portion 270 are each coupled at a different location on the connector 234. Thus, the first portion 268 and the second portion 270 need not be aligned but can be spaced apart in an angled relationship. As described above, the second portions 270 of the side frame members 262 provides additional stability to the chair 200.

Figure 5:
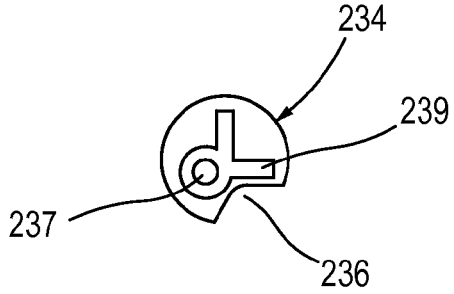
FIG. 5 is a top view of a connector of the frame assembly of FIG. 3*a*.

FIGS. 4 and 5 illustrate one example configuration of a connector 234. The frame 220 can include connectors that have one or more configurations depending on the particular frame members to be coupled and/or the location of the connector 234 on the frame 220. For example, the lower front connectors can have the same configuration or a different configuration than the lower rear connectors. For example, the lower front connectors may not include an opening (e.g., opening 237). In addition, the connectors may be the same or different on a right side of the frame 220 than on a left side of the frame 220. For example, a left side connector may be an opposite or mirror image configuration of a right side connector.

In alternative embodiments, the side frame members 262 can be a single component that includes the first portion 268 and the second portion 270 formed at an angle relative to the first portion 268. In other words, the first portion 268 can be formed monolithically with (unitarily with) or integrally to the second portion 270. In other alternative embodiments, other frame members rather than the side frame members 262 can include an angled foot portion configured to contact a support surface (e.g., a first portion and a second portion angled relative to the first portion as described for side frame members 262). For example, in some embodiments, the front frame members 260 and/or the rear frame members 264 can include a first portion (e.g., 268) and a second portion (e.g., 270) angled relative to the first portion.

Figure 6:
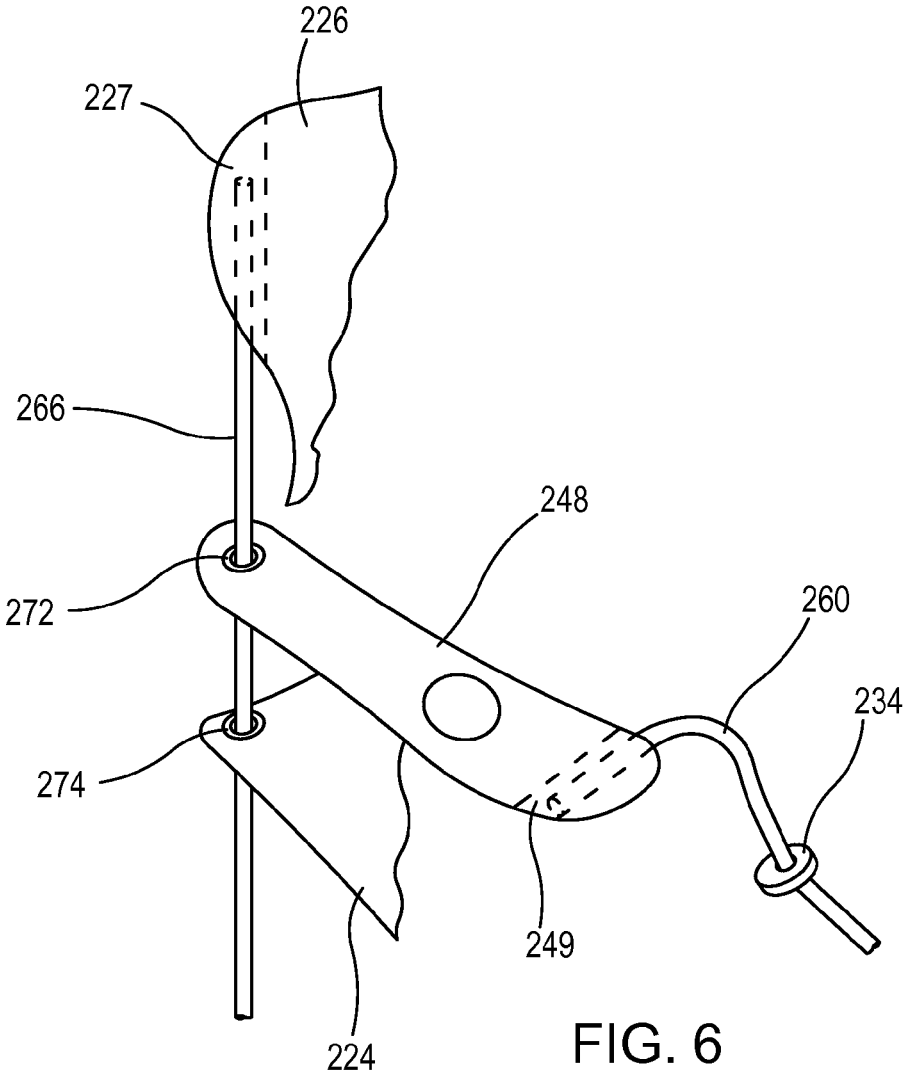
FIG. 6 is a perspective view of a portion of the reconfigurable collapsible chair of FIG. 2.

As shown in FIG. 6 the arm membrane 248 includes an opening with a grommet 272 such that the arm membrane 248 can be slidably coupled to an upright frame member 266. As discussed above, arm membrane 248 is also coupled to the front frame members 260. As shown in FIG. 6, a pocket 249 is formed in a front portion of the arm membrane 248 that can slidably receive a top portion of a front frame member 260. Although not shown it should be understood that the arm membrane 250 can be similarly coupled to the frame 220.

The seat portion 224 can also include an opening with a grommet 274 to be slidably coupled to the upright frame member 266. The seat portion 224 can also include an opening and a grommet at a front portion of the seat member 224 to be slidably coupled to the front frame members 262 in a similar manner. The back support portion 226 includes a pocket 227 configured to receive a top end portion of the upright frame members 266.

Figure 7:
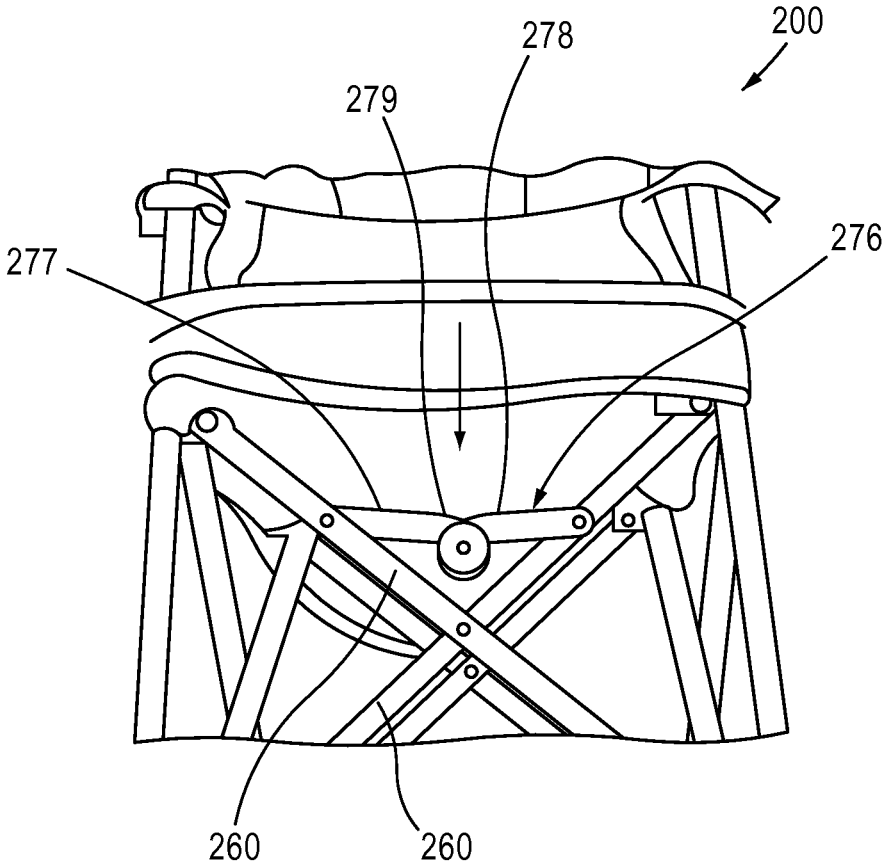
FIG. 7 is front view of a portion of the reconfigurable collapsible chair of FIG. 2.
Figure 8:
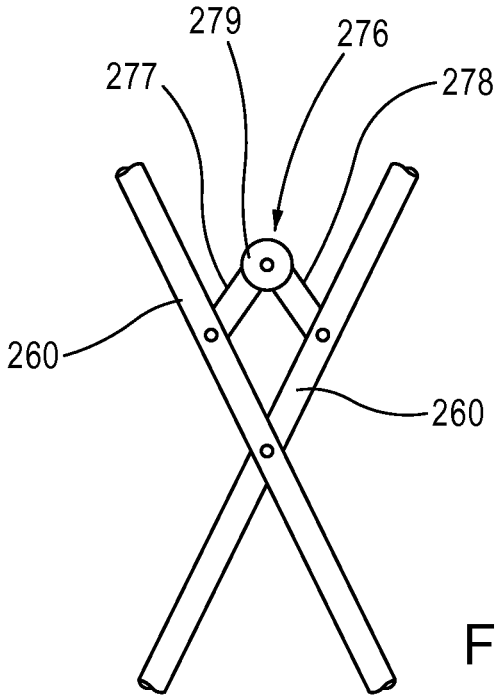
FIG. 8 is a front view of a portion of the reconfigurable collapsible chair of FIG. 2 show in a partially collapsed configuration.

As shown in FIGS. 7 and 8, the locking mechanism 276 is pivotally coupled to the front frame members 260. The locking mechanism 276 can be used to maintain the chair 200 in the expanded configuration during use. The locking mechanism 276 includes a first link 277, a second link 278 and a holding element 279. The links 277 and 278 are each pivotally coupled to a different front frame member 260 as shown in FIGS. 7 and 8. The links 277 and 278 are also pivotally coupled to the holding element 279. When the frame 220 is in its expanded configuration (as shown, e.g., in FIG. 7) the holding element 279 is pushed downward to lock the links 277 and 278 in a substantially horizontal position such that the front frame members 260 are not able to pivot relative to each other. Thus. the frame 220 is prevented from moving to its collapsed configuration. FIG. 8 shows the locking mechanism 276 when it has been released and the frame 220 is in a partially collapsed configuration.

Figure 9:
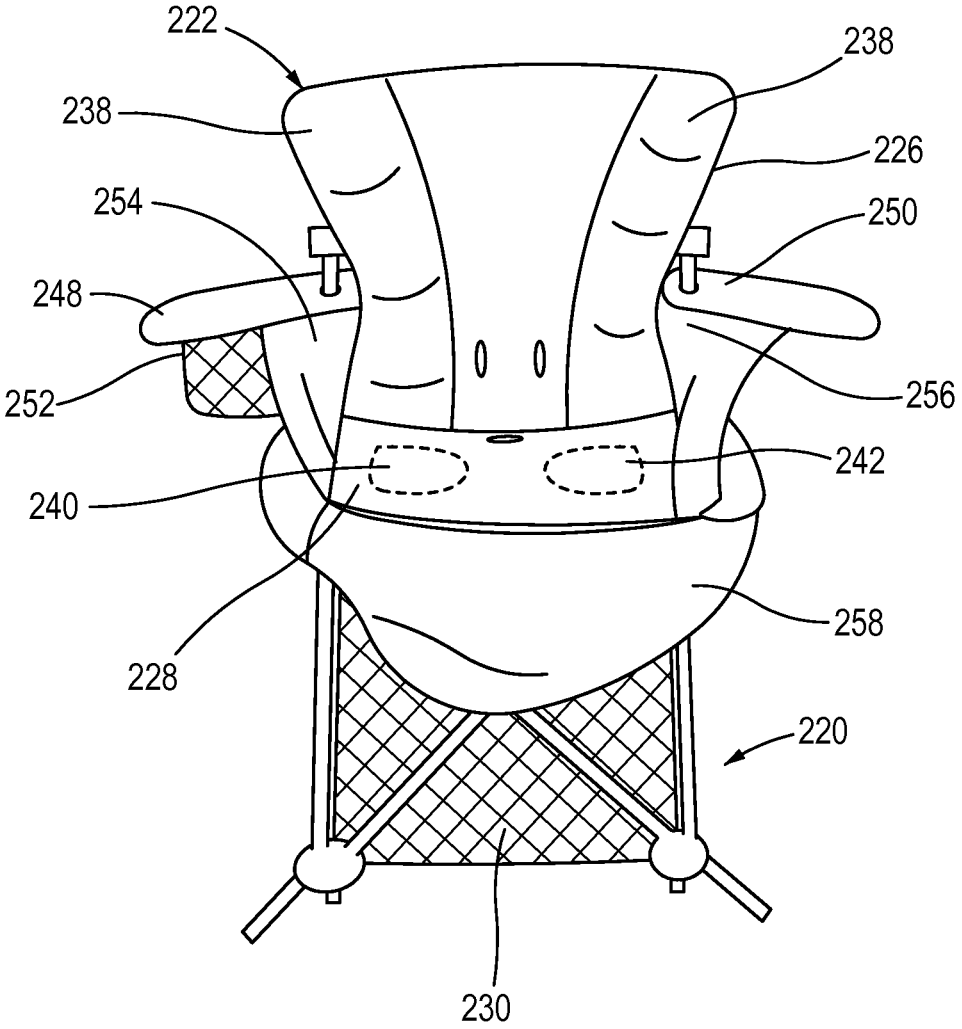
FIG. 9 is a front view of the reconfigurable collapsible chair of FIG. 2.
Figure 10:
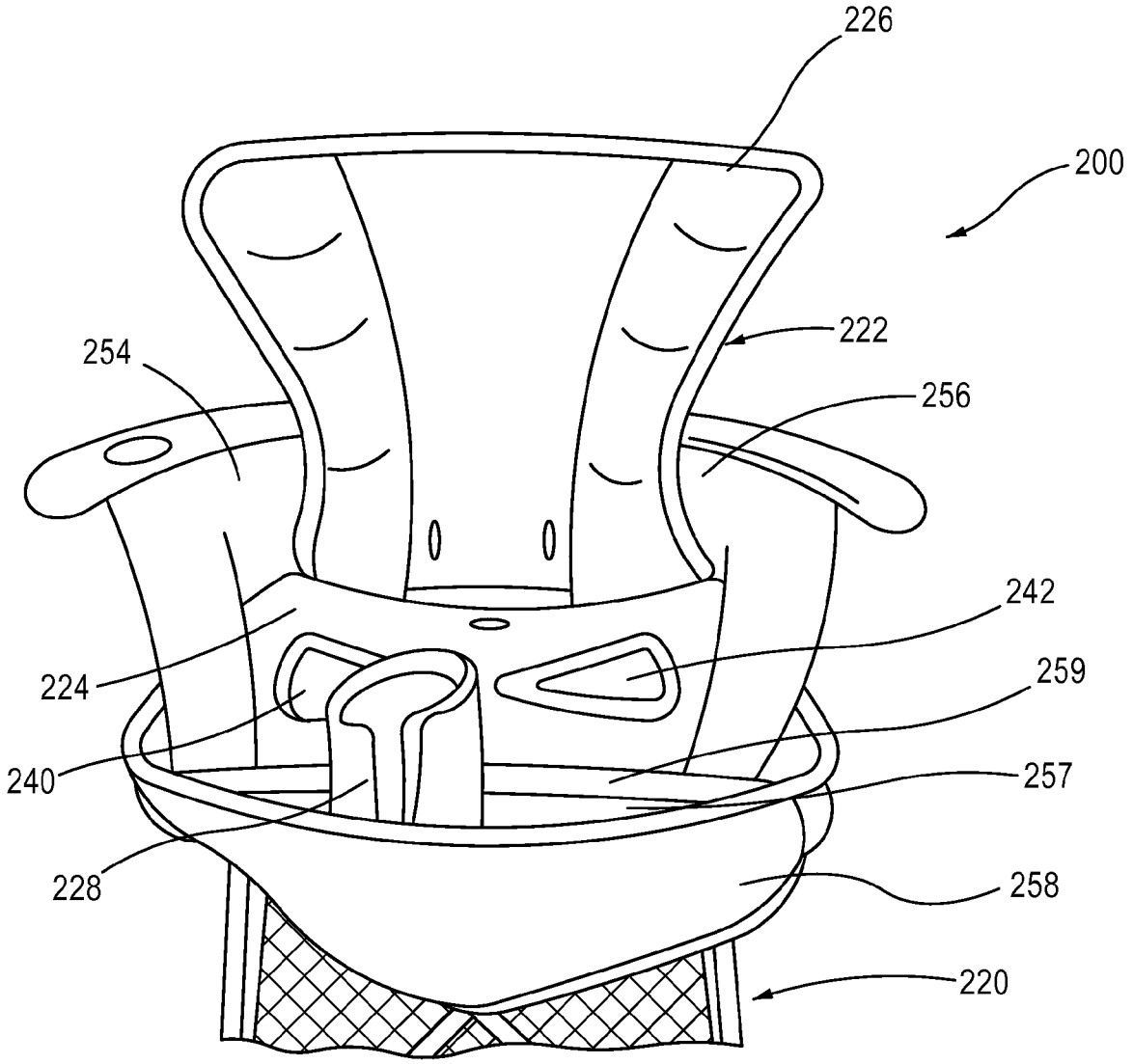
FIG. 10 is a front view of a portion of the reconfigurable collapsible chair of FIG. 2.
Figure 11:
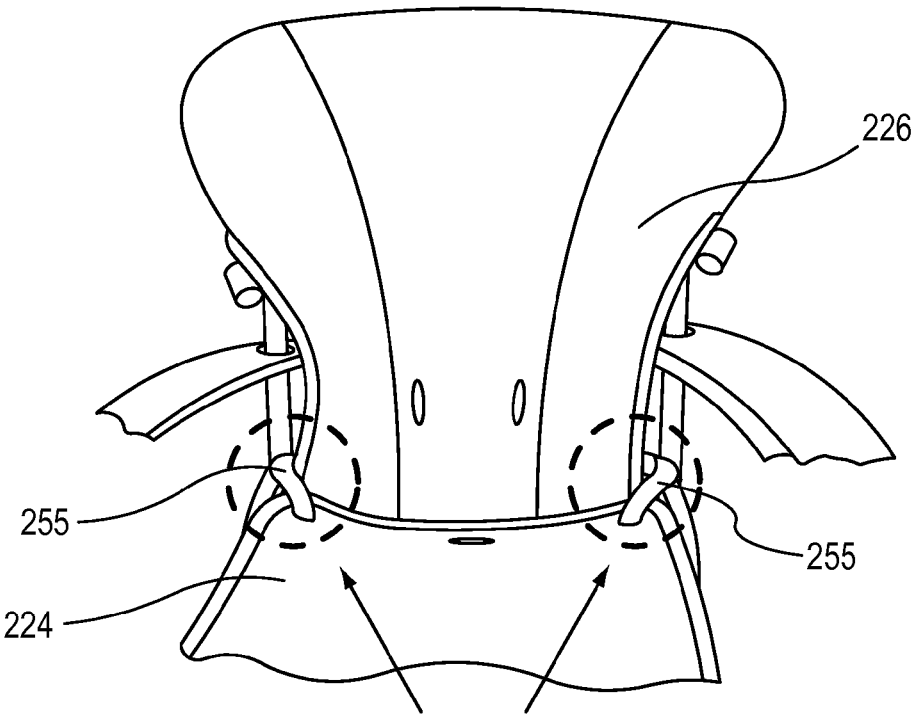
FIG. 11 is a front view of a portion of the reconfigurable collapsible chair of FIG. 2.

As shown in FIG. 9, the chair 200 also includes a second membrane 228 in the form of a seat cover and a third membrane 230 that can be used as an enclosure to protect a user's legs when using the chair 200 while in a standing position. The second membrane 228 is configured to be placed in a first position in which the second membrane 228 is disposed at least partially on a top surface of the seat portion 224 such that the first opening 240 and the second opening 242 are covered by the second membrane 228 as shown in FIG. 9. The second membrane 228 can be moved to a second position in which the second membrane 228 is not disposed on (covering) the seat portion 224 and the first opening 240 and the second opening 242 are uncovered or exposed (as shown, for example, in FIG. 2). The second membrane 228 can be stowed in the first storage pouch 258 when in its second position. For example, the first storage pouch 258 can include an opening 257 through which the second membrane 228 can be inserted.

Figure 12:
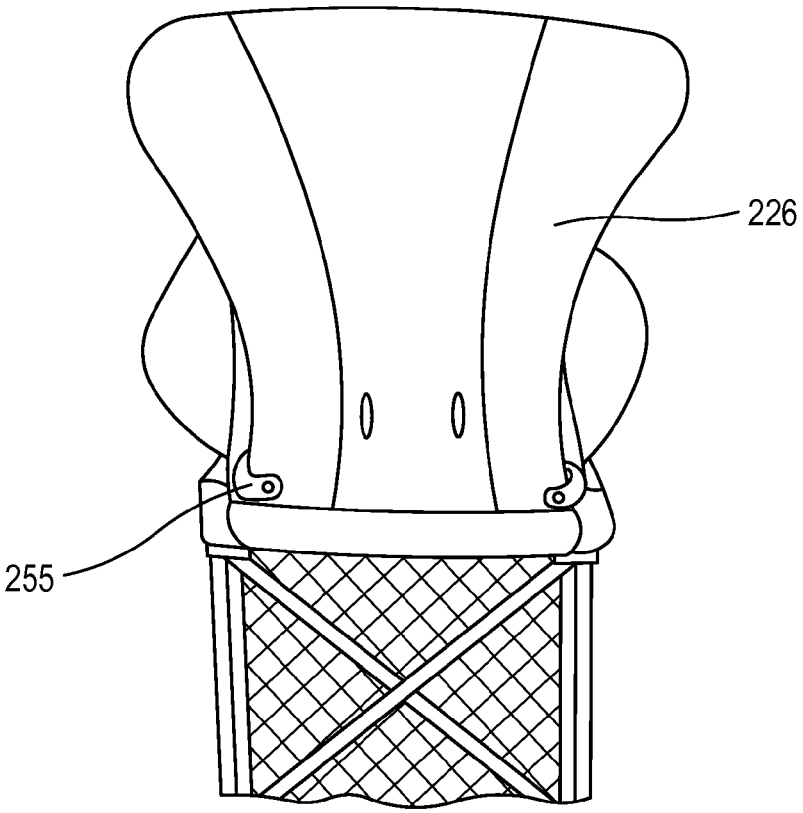
FIG. 12 is a rear view of a portion of the reconfigurable collapsible chair of FIG. 2.

To move the second membrane 228 to its first position, the second membrane 228 is removed from the first storage pouch 258 (pulled through the opening 257) (see, e.g., FIG. 10) and placed over the seat portion 224 (see, e.g., FIG. 9). The second membrane 228 can be removably coupled to the first membrane 222 when the second membrane 228 is in its first position. For example, the second membrane 228 includes straps 255 (see FIG. 11) with a coupling member such as snaps to couple the second membrane 228 to the back side of the back support portion 226 as shown in FIG. 12. In alternative embodiments, other coupling methods can be used, such as buckles, buttons, hook and loop fasteners, etc. to couple the second membrane 228 to the back support portion 226. A front portion of the second membrane 228 can include a hook and loop fastening member (not shown) configured to couple to a mating hook and loop fastening member 259 on the inside edge of the first storage pouch 258. As described above, in alternative embodiments, a portion of the second membrane 228 can be fixedly coupled to the frame 220, the first membrane 222 and/or the first storage pouch 258. The first storage pouch 258 can also include a hook and loop fastening member (not shown) that can matingly couple to the hook and loop fastening member 259 to close the first pouch 258 when the second membrane 228 is disposed therein. Other types of closure members can alternatively be used, such as, for example, snaps, buttons, etc. to close the first storage pouch 258.

When the second membrane 228 is in its first position, and the frame is in its expanded configuration, a user of the chair 200 can be supported on the chair in a seated position. When the second membrane 228 is in its second position, the user of the chair 200 can be supported in a standing position with their legs inserted through the first opening 240 and the second opening 242. Thus, movement of the second membrane 228 between its first position and its second position allows the chair 200 to be reconfigured for use by a user in a sitting or standing position.

Figure 13:
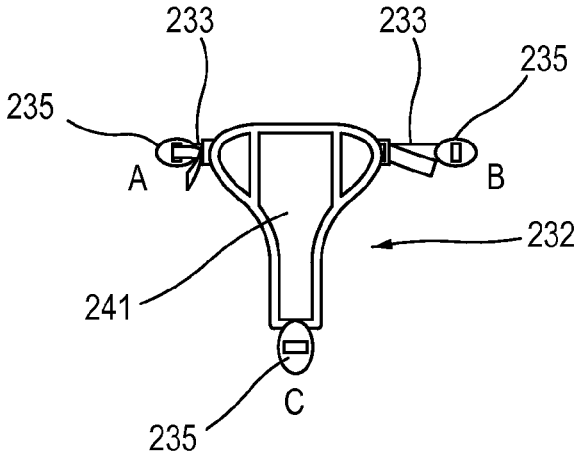
FIG. 13 is a front view of a harness according to an embodiment.
Figure 14:
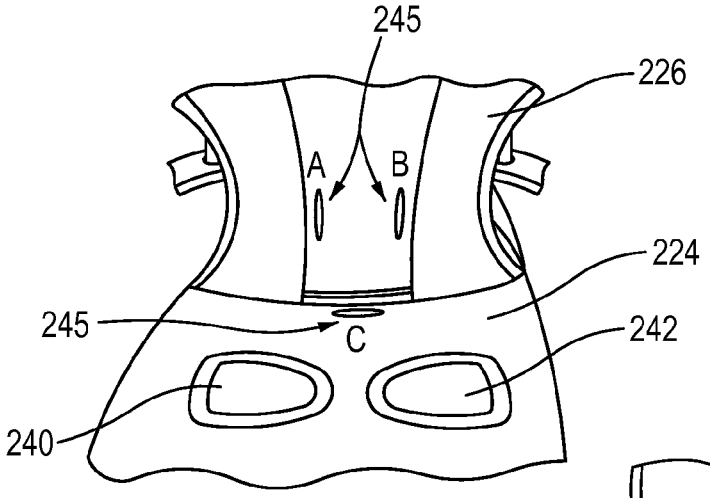
FIG. 14 is a front view of a portion of the reconfigurable collapsible chair of FIG. 2, shown with the seat cover in a stowed position.
Figure 15:
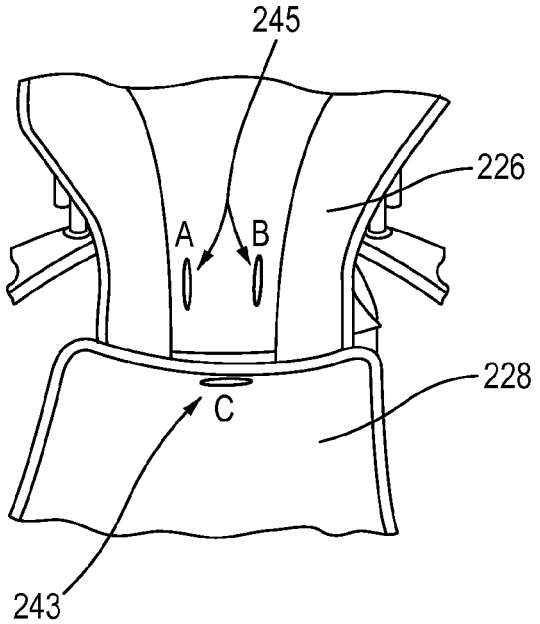
FIG. 15 is a front view of a portion of the reconfigurable collapsible chair of FIG. 2, shown with the seat cover in a deployed position.

As shown in FIGS. 13-15, a harness 232 can be provided that can be coupled to the first membrane 222 and used to securely hold the user (e.g., baby or small child) in position in either the seated or standing positions. The harness 232 is coupled to the first membrane 222 at three coupling locations A, B and C shown in FIGS. 13-15. The harness 232 includes a harness membrane 241 and adjustable straps 233 each coupled to a clips 235. A clip 235 is also coupled to the harness at coupling location C. When the harness 232 is to be used when the user is in a standing position, the clip 235 disposed at coupling location C on the harness 232 can be inserted into a corresponding slot 245 defined in the seat portion 224 at location C as shown in FIG. 14. The clip 235 at coupling locations A and B on the harness 232 can likewise be inserted into corresponding slots 245 defined at locations A and B in the back support portion 226. When the chair 200 is to be used with the user in a sitting position (see FIG. 15), the clip 235 at coupling location C on the harness 232 can be inserted into a corresponding slot 243 defined at location C on the second membrane 228, which also corresponds to slot 245 at location C in the seat portion 224 (disposed below second membrane 228) as shown in FIG. 15. The clip 235 at coupling locations A and B in the harness 232 can be inserted into the corresponding slots 245 defined at locations A and B in the back support portion 226. The clips 235 can be inserted into their corresponding slots (e.g., slots 245, 243) and oriented in a similar manner as inserting a button in a button hole. In other embodiments, alternative coupling methods can be used, such as, for example, buttons, snaps or hook and loop fasteners.

Figure 16:
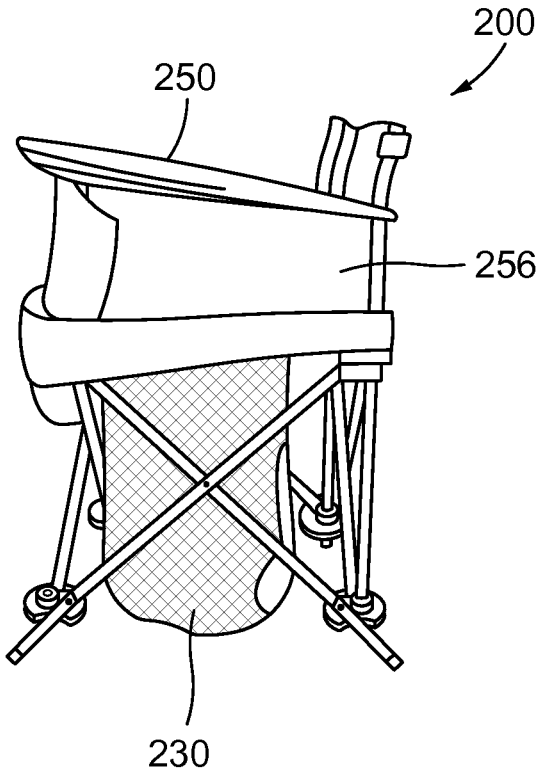
FIG. 16 is a side view of a portion of the reconfigurable collapsible chair of FIG. 2, shown with the enclosure in a deployed position.
Figure 17:
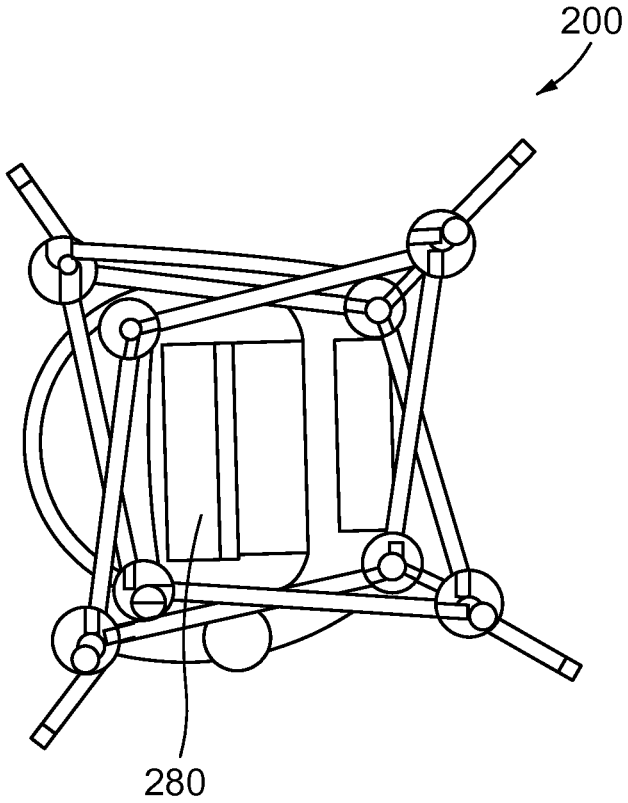
FIG. 17 is a bottom view of a portion of the reconfigurable collapsible chair of FIG. 2, shown with the enclosure in a stowed position.

The third membrane 230 can be moved between a first position in which the third membrane 230 is in a stored position (as shown in FIG. 3) and a second position in which the third membrane 230 forms an enclosure below the seat portion 224 of the first membrane 222 as shown, for example, in FIGS. 9 and 16. When in its first position, the third membrane 230 can be stored in a second storage pouch or pocket 280 shown in FIG. 17. The second storage pouch 280 can be coupled to the frame 220 and/or the first membrane 222 beneath the seat portion 224 of the first membrane 222, such that the third membrane 230 can be stored beneath the seat portion 224 and readily available for use.

When the third membrane 230 is in its second position, the third membrane 230 defines an interior region configured to receive the feet and at least a portion of legs of a user when in a standing position on the chair 200. More specifically, when the user is supported in the chair 200 in the standing position with the user's legs disposed through the first opening 240 and the second opening 242 of the seat portion 224, the third membrane 230 can provide an enclosure for the user's feet and legs. This may be desirable, for example, to protect the user's legs from insects and or dirt when the chair 200 is used outdoors.

A portion of the third membrane 230 can be fixedly coupled to the frame 220 and/or the first membrane 222 and or the second storage pouch 280. In this embodiment, a top portion of the third membrane 230 (e.g., a top edge) is coupled to an interior portion of the second storage pouch 280. For example, the third membrane 230 can be sewn to the second storage pouch 280. In alternative embodiments, the third membrane 230 can be sewn or otherwise coupled to an underside of the seat portion 224 of the first membrane 222. In alternative embodiments, the third membrane 230 can be removably coupled to the frame 220 and/or the first membrane 222 and/or the second storage pouch 280. The third membrane 230 can include a coupling member, such as, for example, snaps, buckles, straps, hook and loop fasteners, etc. to couple the third membrane 230 to the first membrane 222 and/or the frame 220 and/or the second storage pouch 280 when in its second position deployed as an enclosure beneath the seat portion 224.

Figure 18:
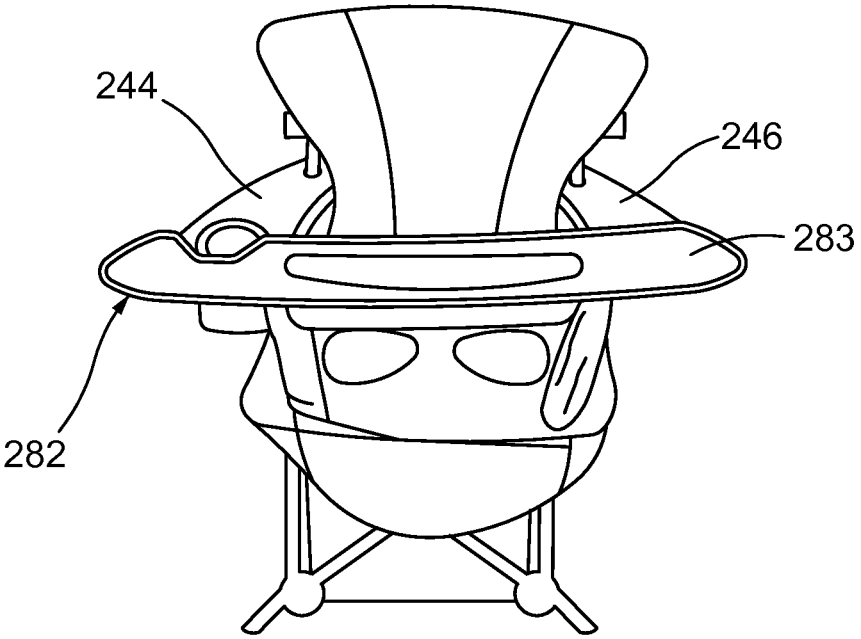
FIG. 18 is front view of the reconfigurable collapsible chair of FIG. 2 shown with a removable tray coupled thereto.
Figure 19:
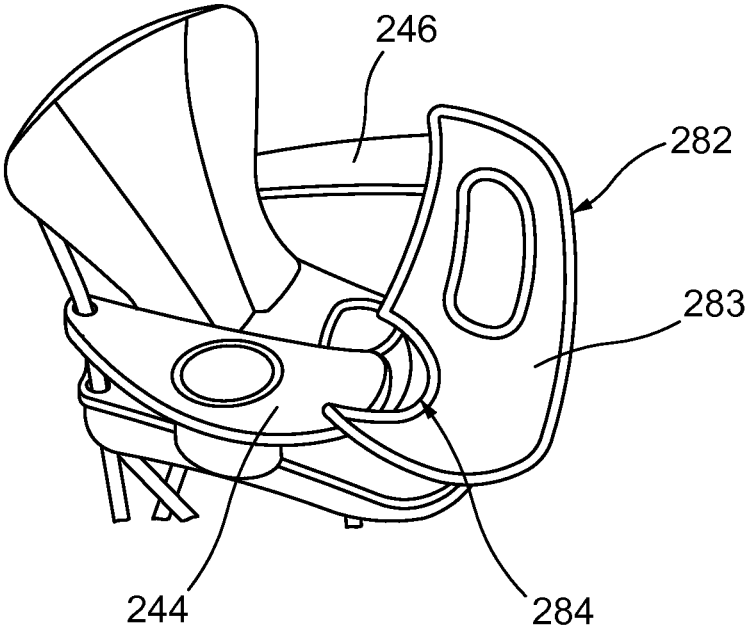
FIG. 19 is a perspective view of a portion of the reconfigurable collapsible chair of FIG. 2 and the removable tray of FIG. 18.

As shown in FIGS. 18 and 19, a tray 282 can be removably coupled to the arm rests 244 and 246 of the chair 200. The tray 282 includes a tray membrane 283 that includes a pair of pockets 284 (only one shown) disposed on an under side of the tray membrane 283. The pockets 284 are each configured to receive a portion of an arm rest 244 or 246. Hook and loop type attachments can be provided within the pockets 284 to hold the tray 282 in position on the arm rests 244 and 246. To couple the tray 282 to the chair 200, each of the pockets 284 are opened and slid over a respective arm rests 244, 246. The pockets 284 can be squeezed such that the hook and loop attachments are secured.

Figure 20:
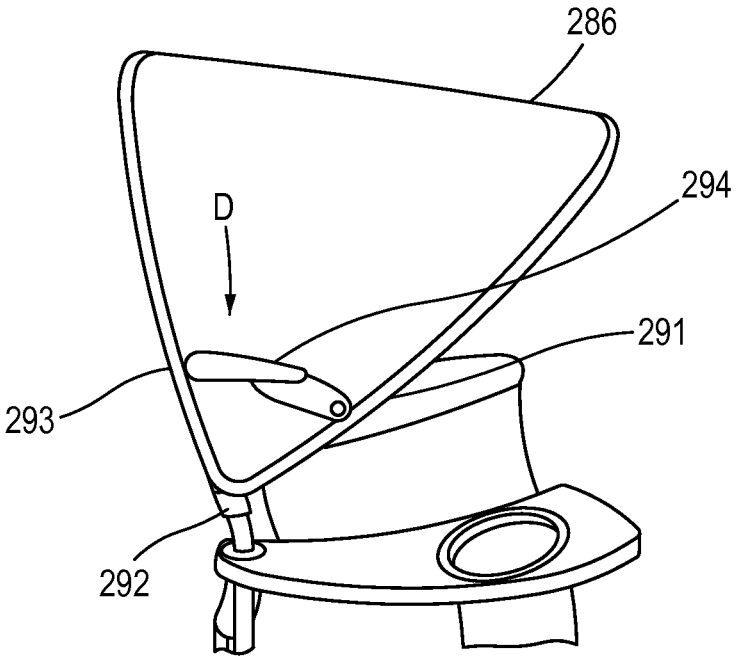
FIG. 20 is a side view of a portion of the reconfigurable collapsible chair of FIG. 2 shown with a removable sun canopy coupled thereto and a lock member in a locked position.
Figure 21:
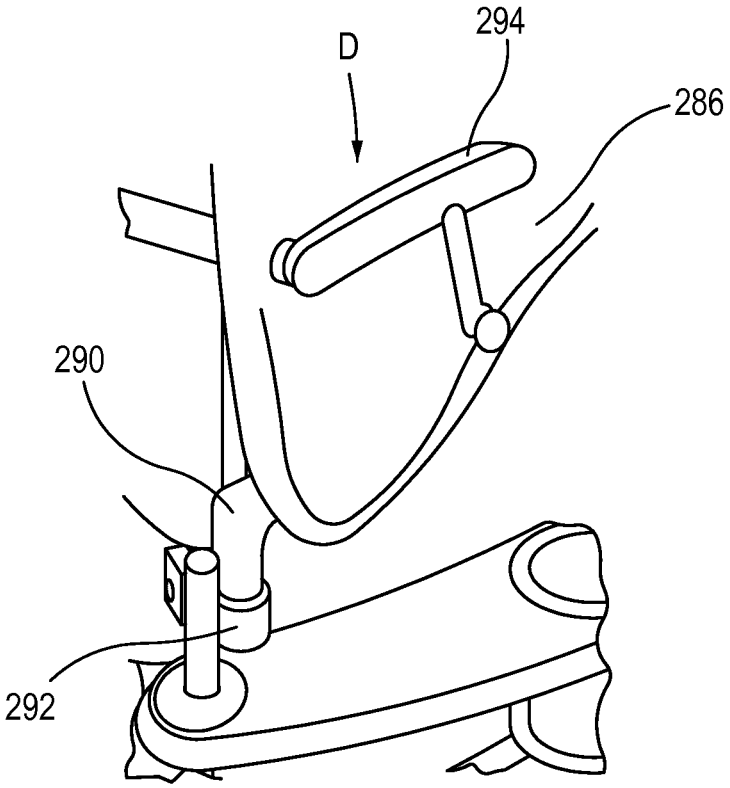
FIG. 21 is a side view of a portion of the reconfigurable collapsible chair of FIG. 2 shown with a portion of the removable sun canopy of FIG. 20 and the lock member in an unlocked position.

As shown in FIGS. 20 and 21, the detachable sun canopy 286 includes a canopy membrane 288 coupled to peripheral frame (not shown) and a pair of mounting posts 290. The mounting posts 290 can be received in mating receiving members 292 coupled to the frame 220. To removably attach the sun canopy 286 to the chair 200, the mounting posts 290 are placed within openings of the receiving members 292. A pivotal lock member 294 that is coupled to the membrane 288 is pushed downward in a direction of arrow D to extend the lock member 294 between a front portion 291 and a rear portion 293 of the peripheral frame of the sun canopy 286 to maintain the sun canopy 286 in a taut or stretched configuration as shown in FIG. 21.

Figure 22:
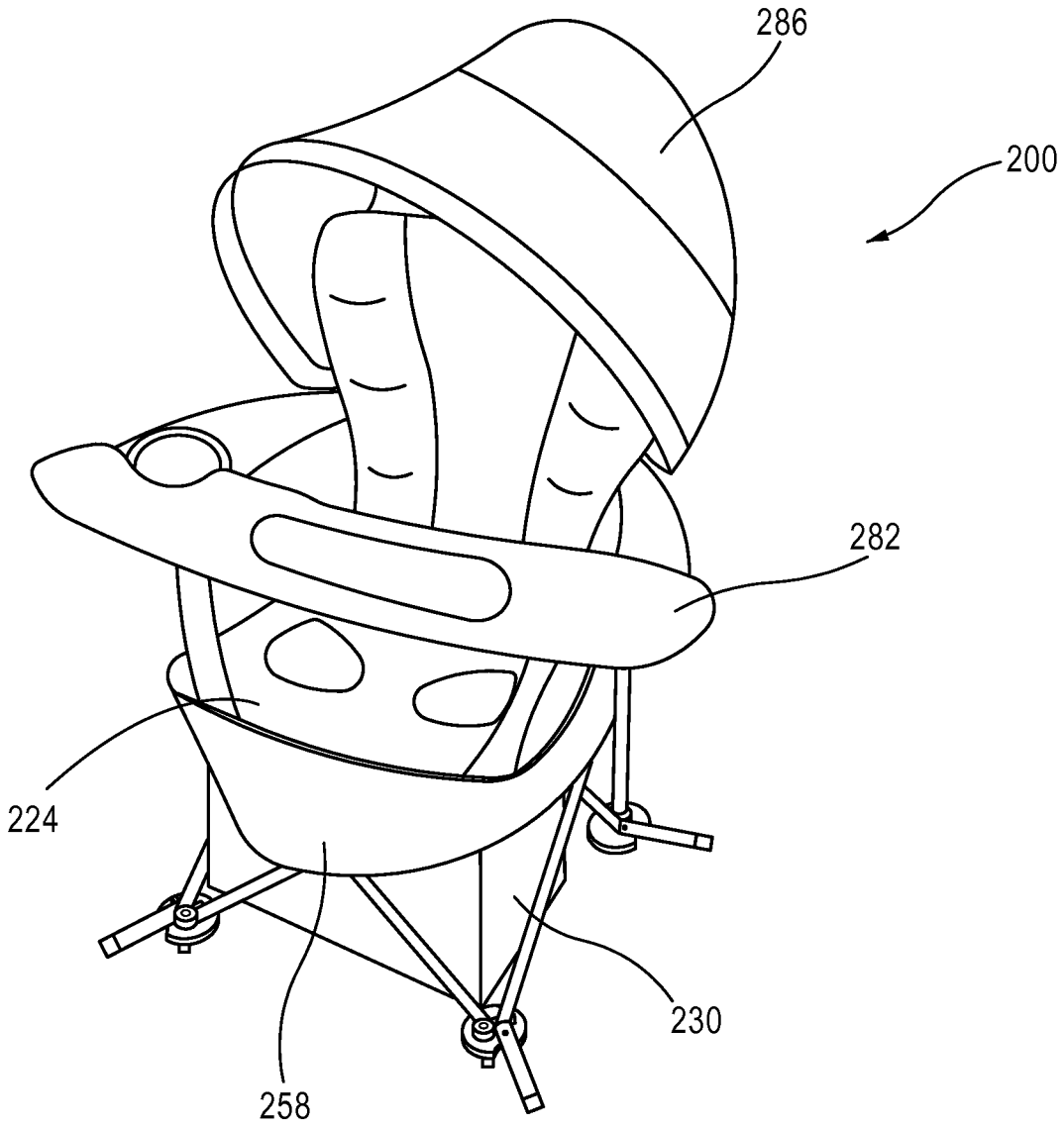
FIG. 22 is a front perspective view of the reconfigurable collapsible chair of FIG. 2 shown with the removable tray of FIG. 18 and the removable sun canopy of FIG. 20 coupled thereto.

FIG. 22 illustrates the chair 200 in an expanded configuration with the tray 282 and sun canopy 286 coupled thereto. FIG. 22 also illustrates the third membrane 230 disposed in its second position as an enclosure and the second membrane 228 disposed in its second position stored in the first storage pouch 258. As discussed above, in this configuration of the chair 200, a user can be positioned in the chair 200 in a standing position.

Figure 23:
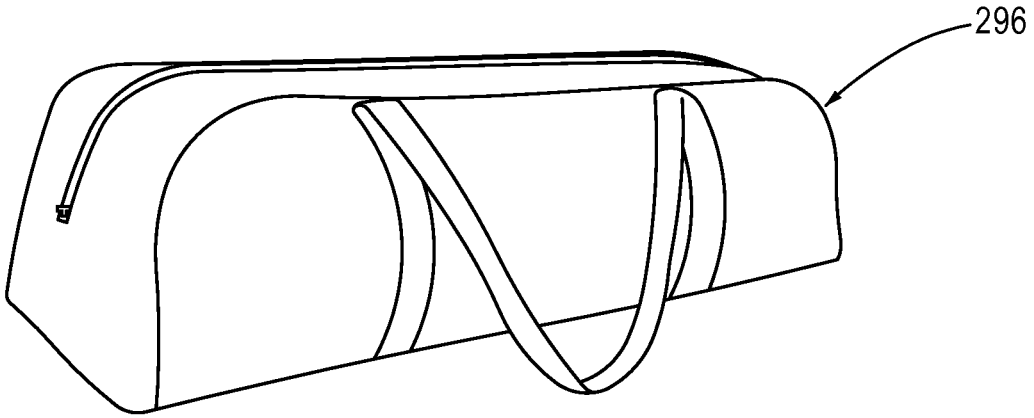
FIG. 23 is a side perspective view of a carrying bag according to an embodiment.

FIG. 23 is a side perspective view of a carrying bag 296 that can be used to store and transport the chair 200 and its various components. For example, the carrying bag 296 can contain the chair 200 (in a collapsed configuration), the harness 232, the sun canopy 286, the tray 282 and/or combinations thereof. The carrying bag 296 can also be configured to be semi-rigid such that it can remain standing when the chair 200 is removed to aid in removal and insertion of the chair 200, canopy 286 and tray 282.

Figure 24:
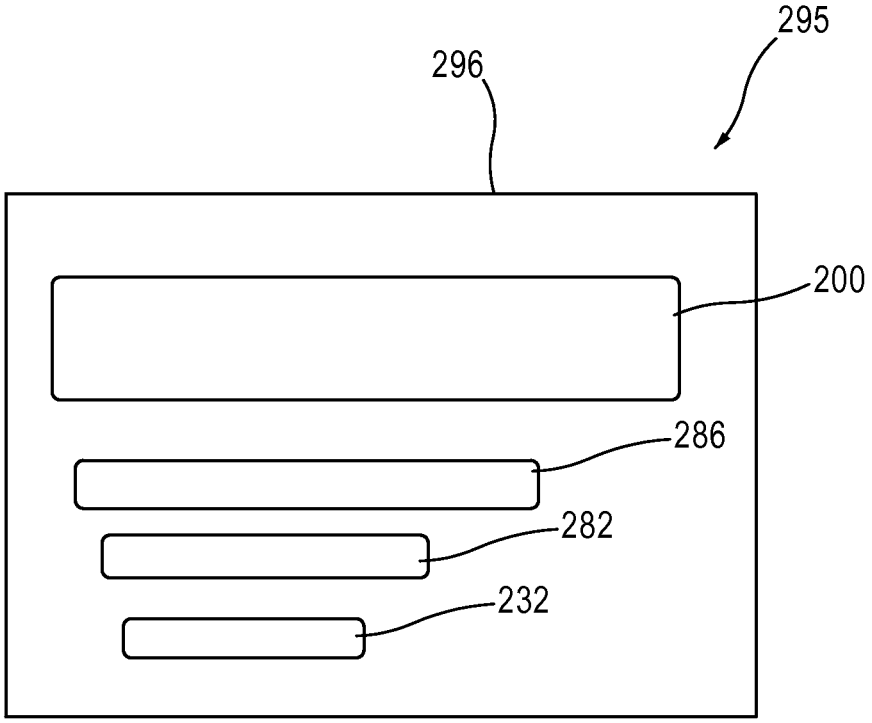
FIG. 24 is a schematic illustration of a kit according to an embodiment.

FIG. 24 is a schematic illustration of a kit 295 that includes the chair 200, the harness 232, the sun canopy 286, the tray 282 and the carrying bag 296. A kit can alternatively include, for example, only the chair 200 and the carrying bag 296. In some embodiments, a kit includes a chair 200, a harness 232 and a carrying bag 296. In alternative embodiments, a kit can include other combinations and sub-combinations of the various components described herein.

The first membrane 222, the second membrane 228, the third membrane 230, the arm membranes 248 and 250, side panels 254 and 256, the harness membrane 241, the canopy membrane 288, the tray membrane 283 and the carrying bag 296 can each be formed with any suitable strong, weather resistant, flexible material. Suitable fabrics can include, for example, nylon, cotton, rayon, fiberglass fabrics and flexible plastic sheets.

The frame 220 (e.g., it s frame members) can be formed with any suitable strong, resilient, lightweight, material(s). The frame members can be formed, for example, with plastic, aluminum, and/or wood. Tubular materials are also suitable. The connectors 234 can be formed with, for example, plastic, aluminum, and/or steel.

Figure 25:
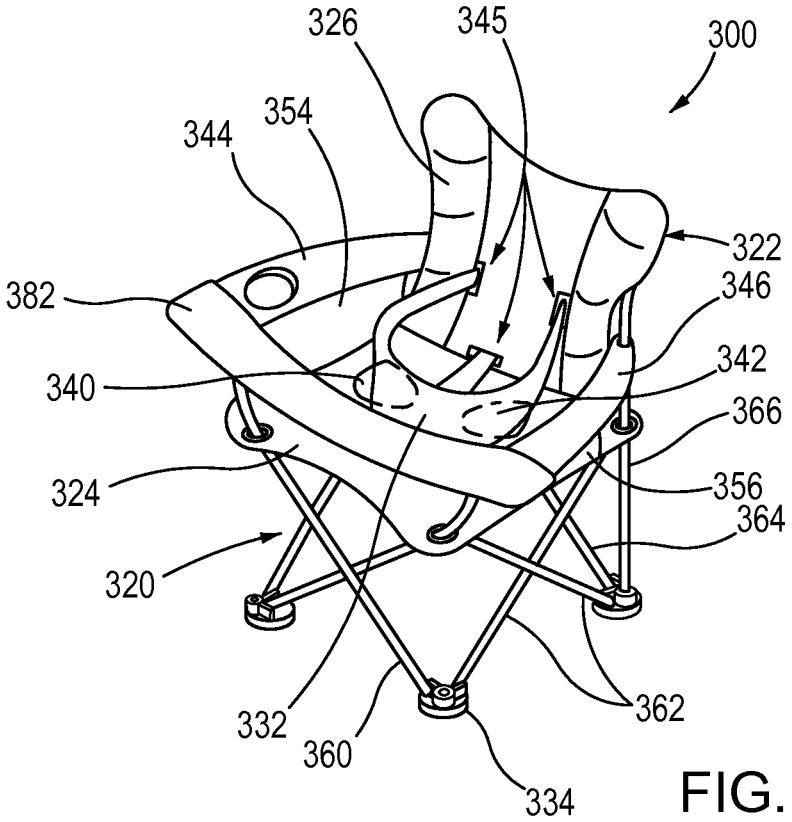
FIG. 25 is a front perspective view of a reconfigurable collapsible chair according to another embodiment, shown in a first configuration with the openings on the seat portion exposed.
Figure 26:
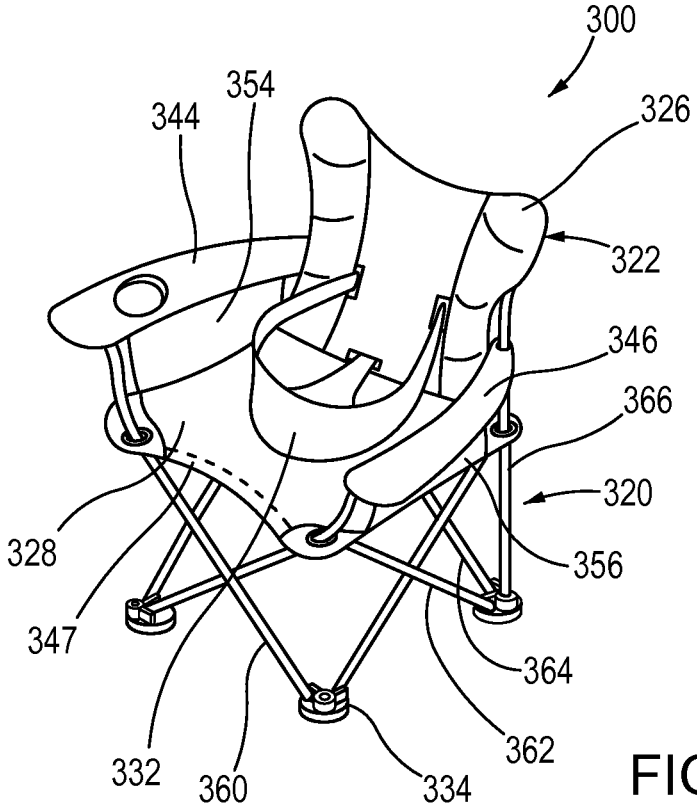
FIG. 26 is a front perspective view of a reconfigurable collapsible chair of FIG. 25, shown in a second configuration with the openings on the seat portion covered by a membrane.

FIGS. 25 and 26 illustrate another embodiment of a reconfigurable collapsible chair. A reconfigurable collapsible chair 300 includes a frame assembly 320 and a first membrane 322. The first membrane 322, armrests 344 and 346, side panels 354 and 356, a harness 332, and a removable tray 382 each of which can be configured in a similar manner and formed with the same materials as the corresponding components described above for previous embodiments.

The frame assembly 320 (also referred to herein as "frame") can be configured to be moved between a closed or collapsed configuration for storage and transport, and an expanded or open configuration for use as described above for previous embodiments. The chair 300 can also be reconfigured for use in a seated position or a standing position as previously described. The frame 320 includes front frame members 360, side frame members 362, rear frame members 364, upright frame members 366, and connectors 334 similar to as described above for chair 200 and frame 220. In this embodiment, however, the frame 320 does not include angled foot portions, as shown in FIGS. 25 and 26. In this embodiment, the lower connectors 334 contact and support the chair 300 on a support surface.

The first membrane 322 includes a seat portion 324 and a back support portion 326. The seat portion 324 defines openings 340 and 342 configured to receive a user's legs therethrough when the user is positioned in the chair 300 in a standing position. The back support portion 326 includes slots 345 to insert clips (not shown) on the harness 332 as described above for harness 232. As shown in FIGS. 25 and 26, in this embodiment, the slots 345 are all disposed on the back support portion 325. It should be understood, however, that the seat portion 324 and a second membrane (described below) can include a slot to couple the harness 332 thereto in a similar manner as described above for chair 200.

The chair 300 also includes a second membrane 328 in the form of a seat cover. The second membrane 328 is configured to be placed in a first position in which the second membrane 328 is disposed at least partially on the seat portion 324 such that the first opening 340 and the second opening 342 are covered by the second membrane 328 as shown in FIG. 26 (FIG. 26 is shown with the tray 382 removed). The second membrane 328 can be moved to a second position in which the second membrane 328 is not disposed on the seat portion 324 and the first opening 340 and the second opening 342 are uncovered or exposed as shown in FIG. 25. Although not shown in FIGS. 25 and 26, the chair 300 can include a storage pouch (similar to first storage pouch 258 described above) to store the second membrane 328 when in the second position.

In this embodiment, the second membrane 328 can be removably coupled to the first membrane 322 when in its first position. For example, to move the second membrane 328 to its first position, the second membrane 328 is placed over the seat portion 324 as shown in FIG. 26. The second membrane 328 includes straps (not shown) with a coupling member such as snaps to couple the second membrane 328 to a back side of the back support portion 326 as described above for chair 200. In alternative embodiments, other coupling methods can be used, such as buckles, buttons, hook and loop fasteners, etc. In this embodiment, a front edge of the second membrane 328 can include flange 347 with a hook and loop fastening member configured to be folded under the seat portion 324 and be coupled to a mating hook and loop fastening member (not shown) on the back side of the seat portion 324. It should be understood, however, that other coupling methods can alternatively be used.

As with the previous embodiments, when the second membrane 328 is in its first position (as shown in FIG. 26), and the frame is in its expanded configuration, a user of the chair 300 can be supported on the chair 300 in a seated position. When the second membrane 328 is in its second position (the openings in seat portion 324 are exposed), the user of the chair 300 can be supported in a standing position with their legs inserted through the first opening 340 and the second opening 342. Thus, movement of the second membrane 328 between its first position and its second position allows the chair 300 to be reconfigured for use by a user in a sitting or standing position.

Although not shown in FIGS. 25 and 26, the chair 300 can also include a third membrane configured to form an enclosure similar to third membrane 230 described above. The chair 300 can also include a second storage pouch to store the third membrane when not used as an enclosure. The chair 300 can also optionally include a removable sun canopy similar to sun canopy 286. The chair 300 and its various accessories can be stored in a carrying bag and can be included in a kit as described above.

While various embodiments have been described above, it should be understood that they have been presented by way of example only, not limitation, and various changes in form and details may be made. Any portion of the apparatuses and/or methods described herein may be combined in any combination, except mutually exclusive combinations. Where methods and steps described above indicate certain events occurring in certain order, those of ordinary skill in the art having the benefit of this disclosure would recognize that the ordering of certain steps may be modified and that such modifications are in accordance with the variations of the invention. Additionally, certain of the steps may be performed concurrently in a parallel process when possible, as well as performed sequentially as described above.

Although various embodiments have been described as having particular features and/or combinations of components, other embodiments are possible having any combination or sub-combination of any features and/or components from any of the embodiments described herein. The specific configurations of the various components can also be varied. For example, the size and specific shape of the various components can be different than the embodiments shown, while still providing the functions as described herein. Furthermore, each feature disclosed herein may be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. An apparatus, comprising:

a frame having a collapsed configuration and an expanded configuration;

a first membrane coupled to the frame, the first membrane having a seat portion, the seat portion of the first membrane being disposed substantially within a first plane and defining a first opening and a second opening each disposed with the first plane; and a second membrane couplable to at least one of the first membrane or the frame, when the frame is in the expanded configuration the second membrane configured to be moved between a first position in which the second membrane is disposed at least partially on a top surface of the seat portion of the first membrane such that the first opening and the second opening are disposed beneath the second membrane and the second membrane is disposed substantially within a second plane substantially parallel to the first plane, and a second position in which the first opening and the second opening are not covered by the second membrane, the first opening and the second opening each configured to receive a leg of a user when the second membrane is in the second position and the frame is in the expanded configuration, the second membrane being formed with a flexible material, the first membrane and the frame collectively configured to support a user in a seated position when the second membrane is in the first position and the frame is in the expanded configuration, the first membrane and the frame collectively configured to support a user in a standing position with the user's legs disposed through the first opening and the second opening when the second membrane is in the second position and the frame is in the expanded configuration.

2. The apparatus of claim 1, further comprising:

a storage pouch coupled to at least one of the first membrane or the frame, the second membrane configured to be stored within the storage pouch when in the second position.

3. The apparatus of claim 1, further comprising:

a third membrane couplable to at least one of the frame and the first membrane, the third membrane having a first position in which the third membrane is disposed below the seat portion of the first membrane and forms an enclosure defining an interior volume configured to receive at least a portion of the legs of the user when the frame is in the expanded configuration, and a second position in which the third membrane is in a stowed position.

4. The apparatus of claim 3, further comprising:

a storage pouch coupled to at least one of the first membrane or the frame, the third membrane configured to be stored within the storage pouch when the third membrane is in the stowed position.

5. The apparatus of claim 1, further comprising:

a third membrane coupled to at least one of the first membrane or the frame; and a storage pouch coupled to at least one of the first membrane or the frame, the third membrane having a first position in which the third membrane defines an enclosure configured to receive the user's legs when disposed through the first opening and the second opening when the second membrane is in the second position and the frame is in the expanded configuration, the third membrane having a second position in which the third membrane is stowed within the storage pouch.

6. The apparatus of claim 1, further comprising:

an arm rest coupled to the frame; and a side panel coupled to the arm rest and extending between the arm rest and the seat portion of the first membrane.

7. The apparatus of claim 1, wherein the frame includes a plurality of frame members, at least one frame member from the plurality of frame members including a first portion and a second portion disposed at an angle relative to the first portion, the second portion configured to contact a support surface and support the apparatus on the support surface.

8. The apparatus of claim 1, further comprising:

a harness couplable to the first membrane and configured to retain the user while the user is in the seated position and while the user is in the standing position.

9. The apparatus of claim 1, wherein the first membrane includes a back support portion disposed within a third plane, the first plane being disposed substantially transverse to the third plane.

10. An apparatus, comprising:

a frame having a collapsed configuration and an expanded configuration;

a first membrane coupled to the frame, the first membrane having a seat portion, the seat portion of the first membrane defining a first opening and a second opening, the seat portion of the first membrane configured to receive a first leg of a user in the first opening and a second leg of the user in the second opening when the frame is in the expanded configuration; and a second membrane including a top perimeter edge having a front edge portion and a rear edge portion, the top perimeter edge being couplable to at least one of the frame or the first membrane, the second membrane having a first position in which (1) the front edge portion and the rear edge portion of the top perimeter edge of the second membrane are coupled to the at least one of the frame or the first membrane, and (2) the second membrane is disposed beneath the seat portion of the first membrane and within an outer perimeter defined by the seat portion of the first membrane, and (3) forms an enclosure defining an interior region configured to receive at least a portion of the legs of the user when the frame is in the expanded configuration, and a second position in which the second membrane is in a stowed position.

11. The apparatus of claim 10, further comprising:

a storage pouch coupled to at least one of the first membrane or the frame, the second membrane configured to be stored within the storage pouch when in the second position.

12. The apparatus of claim 10, further comprising:

a third membrane couplable to at least one of the, frame or the first membrane, the third membrane having a first position in which the third membrane is disposed at least partially over the seat portion of the first membrane such that the first opening and the second opening are covered by the third membrane, and a second position in which the first opening and the second opening are not covered by the third membrane, the seat portion of the first membrane configured to receive the first leg of the user in the first opening and the second leg of the user in the second opening when the second membrane is in the second position and the frame is in the expanded configuration; and a storage pouch coupled to at least one of the first membrane or the frame, at least one of the second membrane or the third membrane configured to be stored within the storage pouch when in its second position.

13. The apparatus of claim 10, further comprising:

an arm rest coupled to the frame; and a side panel coupled to the arm rest and disposed between the arm rest and the seat portion of the first membrane.

14. The apparatus of claim 10, wherein the frame includes a plurality of frame members, at least one frame member from the plurality of frame members including a first portion and a second portion disposed at an angle relative to the first portion, the second portion configured to contact a support surface and support the apparatus on the support surface.

15. The apparatus of claim 10, further comprising:

a harness couplable to the first membrane and configured to retain the user.

* * * * *